US008360204B2

(12) United States Patent
Worthington

(10) Patent No.: US 8,360,204 B2
(45) Date of Patent: Jan. 29, 2013

(54) SELF-ADJUSTING LADDER LEVELING DEVICE

(75) Inventor: Landon Worthington, Thousand Oaks, CA (US)

(73) Assignee: Landon Innovations, LLC, Moorpark, CA (US)

( * ) Notice: Subject to any disclaimer, the term of this patent is extended or adjusted under 35 U.S.C. 154(b) by 1092 days.

(21) Appl. No.: 11/970,489

(22) Filed: Jan. 7, 2008

(65) Prior Publication Data

US 2008/0230316 A1 Sep. 25, 2008

Related U.S. Application Data

(60) Provisional application No. 60/896,571, filed on Mar. 23, 2007.

(51) Int. Cl.
*E06C 7/44* (2006.01)

(52) U.S. Cl. ..... 182/200

(58) Field of Classification Search ..... 182/200; 248/188.2

See application file for complete search history.

(56) References Cited

U.S. PATENT DOCUMENTS

| | | | | |
|---|---|---|---|---|
| 1,088,167 | A * | 2/1914 | Osterhoudt | 182/200 |
| 1,314,719 | A * | 9/1919 | Townsend | 182/200 |
| 1,516,988 | A * | 11/1924 | Redman | 182/202 |
| 3,086,612 | A * | 4/1963 | McKinley | 182/200 |
| 4,243,122 | A * | 1/1981 | Coutts | 182/200 |
| 4,591,023 | A * | 5/1986 | Hodson | 182/200 |
| 4,993,514 | A * | 2/1991 | Ferguson | 182/200 |
| 6,336,521 | B1 * | 1/2002 | Dennis | 182/200 |
| 6,837,339 | B2 * | 1/2005 | Lees | 182/200 |
| 7,398,980 | B2 * | 7/2008 | Capers et al. | 280/47.31 |
| 2003/0188927 | A1 | 10/2003 | Lees | |

FOREIGN PATENT DOCUMENTS

| | | |
|---|---|---|
| FR | 67094408 | 4/1968 |
| WO | WO85/03103 A1 | 7/1985 |

* cited by examiner

*Primary Examiner* — Katherine W Mitchell
*Assistant Examiner* — Daniel Cahn
(74) *Attorney, Agent, or Firm* — Kelly & Kelley, LLP

(57) ABSTRACT

A self-adjusting ladder leveling device includes a first locking member attached to the ladder, and a second locking member movably associated with the first locking member. First and second legs extend outwardly from the second locking member toward a supporting surface. The second locking member slidably moves in relation to the first locking member as either the first or second leg is engaged with the surface. When both the first and second legs are engaged with the surface, the second locking member is moved into locked engagement with the first locking member, so as to maintain the ladder in a level state. When the first and/or second leg is removed from engagement with the supporting surface, the second locking member is released and is free to move with respect to the first locking member again.

17 Claims, 7 Drawing Sheets

SELF-ADJUSTING LADDER LEVELING DEVICE

BACKGROUND OF THE INVENTION

The present invention generally relates to ladders. More particularly, the present invention relates to a self-adjusting device for supporting a ladder in a level manner on an uneven surface.

One of the most common pieces of equipment for both household and work use is the ladder. Typically, such ladders come as extension ladders or step ladders. Ladders are often used for diverse tasks, such as painting, cleaning gutters, changing light bulbs, cleaning ceiling fans, stocking shelves, etc.

Since the work sites where such ladders are used are often irregular and uneven, care must be taken in properly setting up and deploying the ladders. While standing on the ladder, the worker must balance himself as well as complete the job which may tend to unbalance his stance on the ladder. Any unbalance on a ladder is not desirable. A ladder resting on such uneven ground may not be as stable or as steady as possible, thus distracting the worker, or possibly resulting in a fall.

In the past, placing wood blocks, shims, or other objects or spacers under a ladder leg have been used to adjust the length of one ladder leg to thereby level the ladder. However, using such temporary means tend to be unstable and may be unsafe as the blocks could shift relative to the ladder, causing the ladder to tip and the worker fall, possibly sustaining serious injury.

There do exist devices for leveling ladders. For example, multi-positioned ladders, such as those offered by the Little Giant Corporation, enable the ladder, when in the A-configuration to have one set of legs positioned at a different height than the opposite set of legs, such as when using the ladder on stairs or the like. However, this does not remedy the problem of using the ladder on an irregular surface, wherein only one of the ladder legs is unbalanced. Also, this arrangement provides no remedy to the use of extension ladders on uneven ground.

There exist other leveling devices which are clamped onto one or more legs of the ladder, and which can be selectively telescoped outwardly, so as to level the leg with respect to the other legs. However, this requires the user to manually adjust the length of the extension and lock it in place, which is cumbersome and time-consuming. U.S. Pat. No. 6,336,521 discloses a ladder leveling device which is easier to operate. However, this ladder leveling device also requires that the user unlock bracket assemblies in order to allow the stabilizing arcuate member to be properly positioned so as to level the ladder, and then subsequently manually lock the locking brackets in place.

Accordingly, there is a continuing need for a ladder leveling device which levels a ladder on uneven surfaces. There is also a continuing need for such a leveling device which is automatic and self-adjusting in nature so as not to require manual manipulation. The present invention fulfills these needs, and provides other related advantages.

SUMMARY OF THE INVENTION

The present invention is directed to a self-adjusting device for supporting a ladder in a level manner on an uneven surface. The device of the present invention, as will be more fully described herein, does not require manual adjustment, or locking and unlocking of members, in order to level the ladder and lock the ladder in place in its level state.

The device of the present invention generally comprises a first locking member attached to first and second generally parallel side rails of the ladder. A second locking member is movably associated with the first locking member. A first leg is attached to the second locking member, and extends downwardly toward the surface. A second leg is also attached at a first end to the second locking member and extends downwardly toward the surface. The second locking member is moved relative to the first locking member as the first leg is moved into contact with the surface. The second locking member is moved into locked engagement with the first locking member as the second leg is moved into contact with the surface, and the first and second legs impart a force to the second locking member.

More particularly, the first locking member typically comprises a crossbeam extending generally horizontally between the first and second rails of the ladder. The first locking member includes an open-spaced channel having a plurality of spaced-apart projections disposed therein.

The second locking member is configured to freely slide horizontally along a length of the first locking member when the first and second legs are not exerting a force thereon. However, the second locking member is configured to move vertically into releasable engagement with the first locking member when both the first and second legs exert an upward force thereon. Typically, the second locking member includes at least one projection configured to be inserted between the spaced-apart projections of the first locking member, so as to lock the first and second locking members into engagement with one another and prevent the second locking member from moving along a length of the first locking member. Preferably, first and second stops are provided to limit the horizontal movement of the second locking member, even when not engaged with the first locking member.

The device includes a first guide associated with the first rail for guiding the movement of the first leg. The guide includes a roller in spaced relation to the first rail, such that the first leg is disposed between the roller and the rail. Preferably, a surface-engaging foot is pivotally connected to a second end of the first leg. Similarly, a second guide is associated with the second rail for guiding the movement of the second leg. The second guide includes a roller in spaced relation to the second rail of the ladder, such that the second leg is disposed between the roller and the rail. Preferably, the second leg also includes a surface-engaging foot pivotally connected to a second end thereof.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
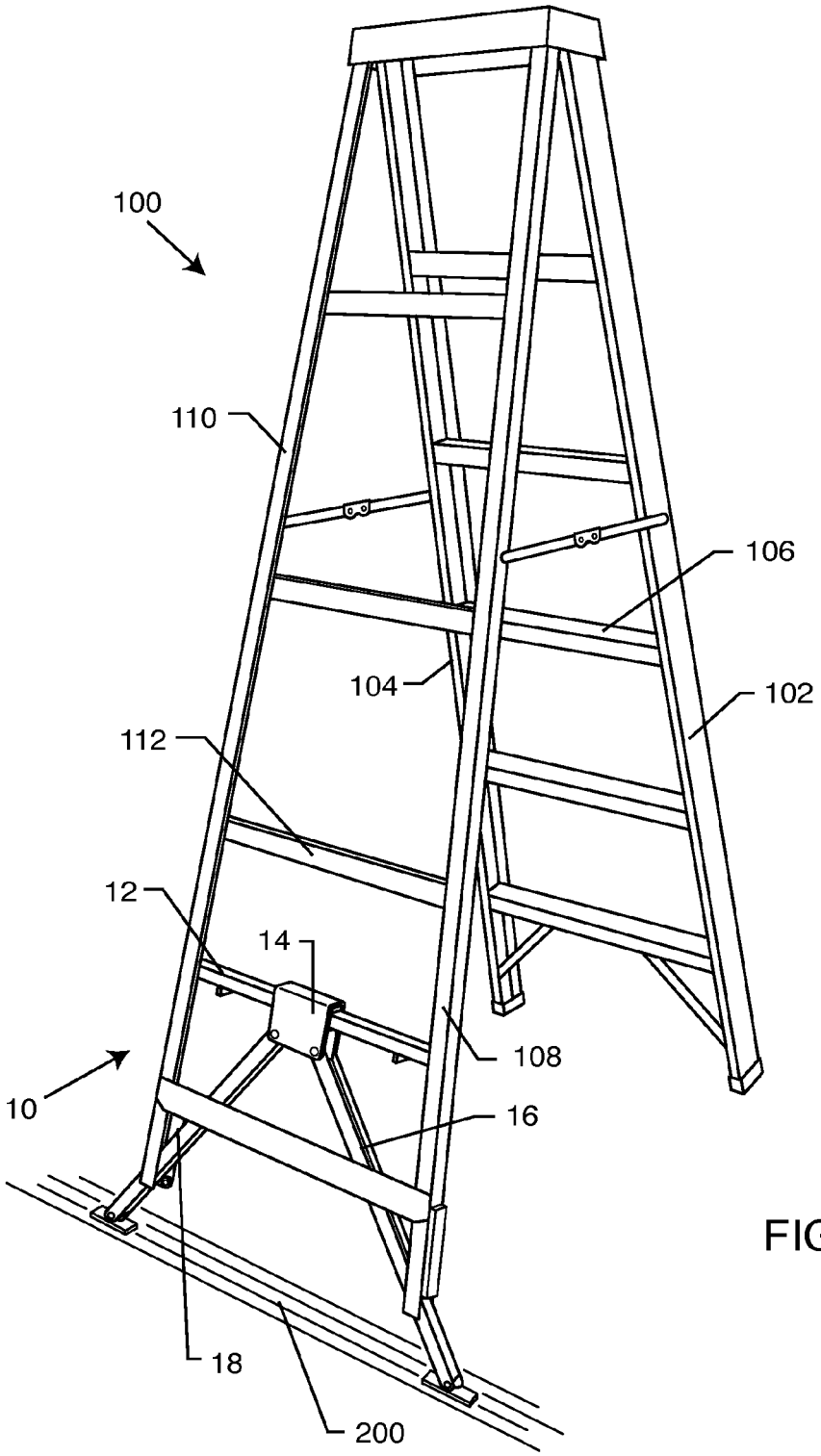
FIG. 1 is a perspective view of an A-frame ladder incorporating the self-adjusting ladder leveling device of the present invention.

As shown in the accompanying drawings, for purposes of illustration, the present invention resides in a self-adjusting ladder leveling device, generally referred to by the reference number 10. As will be more fully described herein, the device 10 is configured to automatically self-adjust to accommodate and position a ladder 100 in a level position on uneven surfaces. As described above, when a ladder 100 is used on generally even and flat surfaces, the ladder 100 is fairly stable and safe. However, when experiencing uneven terrain, such as when one of the legs is positioned either lower or higher than the other legs, instability results. This can be very dangerous to the user of the ladder as such instability may cause the ladder to pivot, and even fall, potentially resulting in injury to the user. The device 10 of the present invention, which is either attached to an existing ladder or manufactured with the ladder, compensates for the uneven supporting surface to maintain the ladder 100 in a generally level position to prevent such tilting of the ladder.

With reference now to the figures, it is well known that ladders have a first set of legs 102 and 104 which are generally parallel to one another. These legs or side rails 102 and 104 are interconnected by a plurality of cross-members or rungs 106. In the case of the ladders illustrated in FIGS. 10 and 11, the cross-member rungs 106 serve as steps. It will be appreciated that the ladders illustrated in FIGS. 10 and 11 can also comprise extension ladders, wherein at least a pair of side rails 102 and 104 are slidably connected to one another so as to telescope inward and outward so as to extend or retract the length of the ladder 100'.

Figure 2:
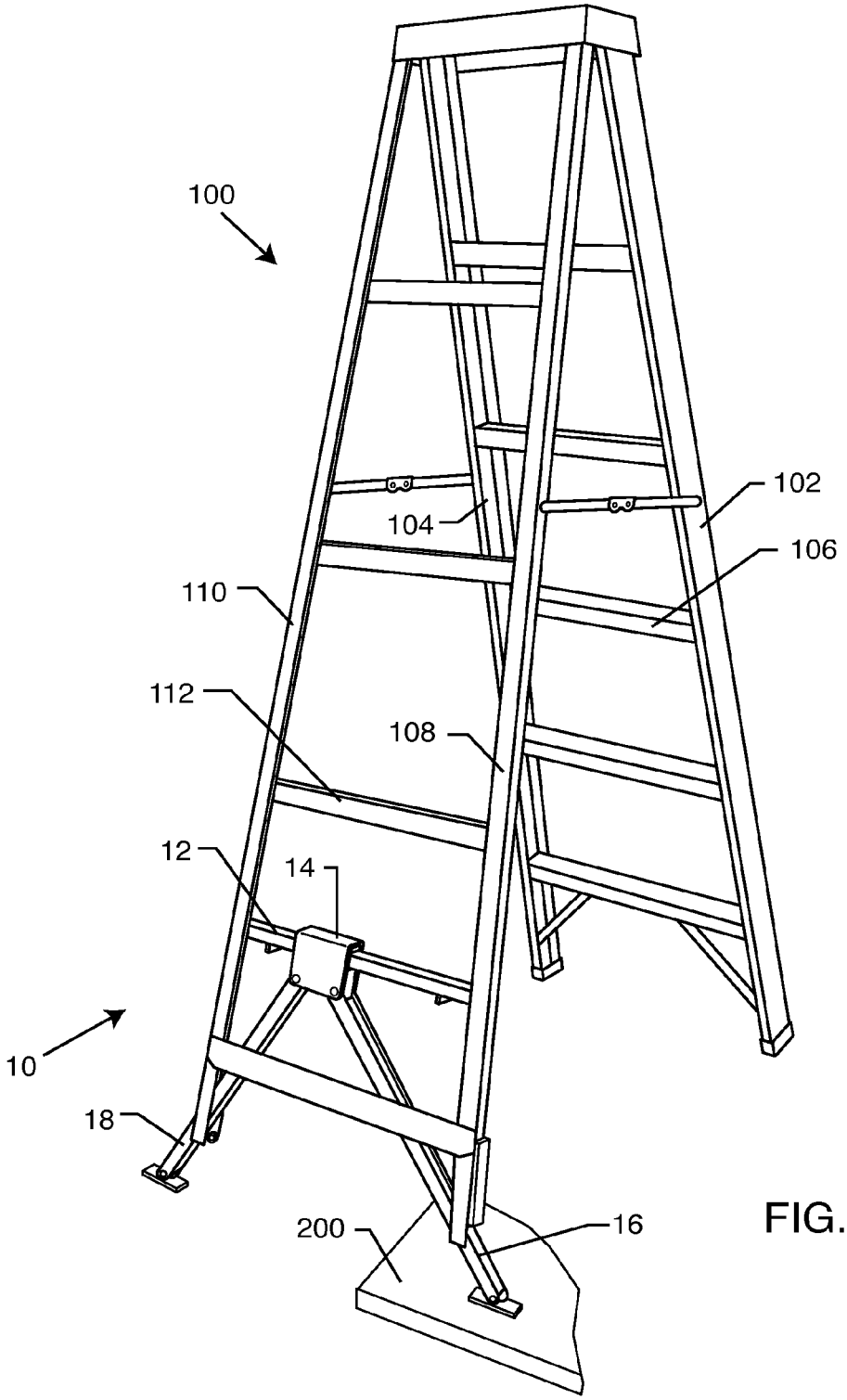
FIG. 2 is a perspective view similar to FIG. 1, but illustrating the ladder positioned on an uneven supporting surface, in accordance with the present invention.

In the ladder 100 illustrated in FIGS. 1 and 2, rungs 106 also serve as steps. However, being an A-frame ladder, an opposite side of legs or rails 108 and 110 are pivotally connected to the first set of rails 102 and 104, so as to retract against the rails 102 and 104 in a storage or transport position, but capable of being extended away from the set of rails 102 and 104 to create a generally A-frame structure forming a step ladder, as illustrated. The third and fourth rails 108 and 110 are also interconnected by a plurality of cross-member rungs 112, which may only serve for structural support, but may also serve as a second set of steps.

With reference to FIGS. 1-8, the device 10 of the present invention includes a first locking member 12 which is attached to a set of the parallel side rails, in FIGS. 1 and 2, the third and fourth side rails 108 and 110. A second locking member 14 is movably associated with the first locking member 12 and releasably engaged therewith in a locking position and an unlocked freely sliding position, as will be more fully described herein. First and second legs 16 and 18 are pivotally connected to the second locking member 14, and extend downwardly toward the supporting surface 200. The supporting surface may comprise ground, a floor, stairs, etc. upon which the ladder 100 is placed. As will be more fully described herein, when only one of the legs 16 or 18 is in engagement with the supporting surface 200, the second locking member 14 is moved with respect to the first locking member 12. However, when both legs 16 and 18 are engaged with the supporting surface 200, and sufficient pressure is applied upwardly, such as when an individual steps upon the rungs 106 or 112 of the ladder 100, then the second locking member 14 moves into locking engagement with the first locking member 12, serving to hold the first and second legs 16 and 18 in place, and the ladder 100 in a generally level position.

In FIG. 1, the supporting surface 200 is generally flat and even, and thus the second locking member 14 is generally centrally positioned with respect to the first locking member. However, as can be seen in FIG. 2, when the ladder is placed on an uneven surface, such as when the leg 16 is placed on a sidewalk, curb, or patch of ground which is elevated with respect to the supporting surface on which leg 18 rests, the slidable second locking member 14 moves out of central alignment with the first locking member 12.

Figure 5:
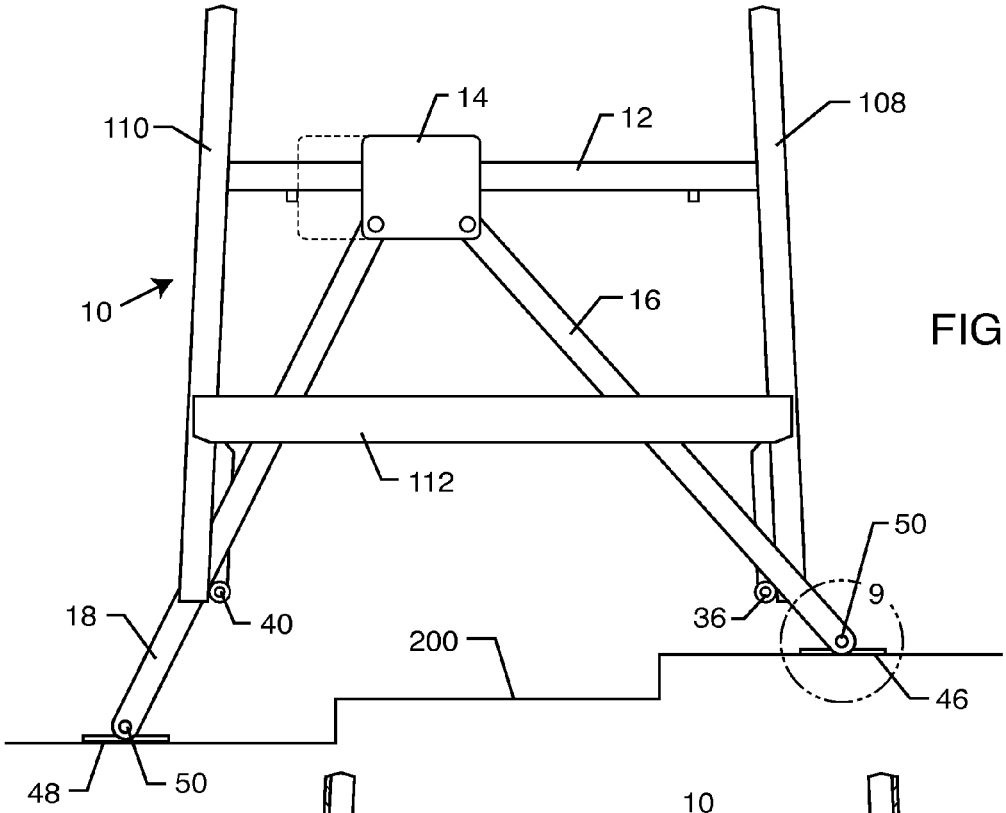
FIG. 5 is a front elevational view similar to FIG. 3, but illustrating the positioning of elements of the device of the present invention in response to being placed on an uneven supporting surface.
Figure 6:
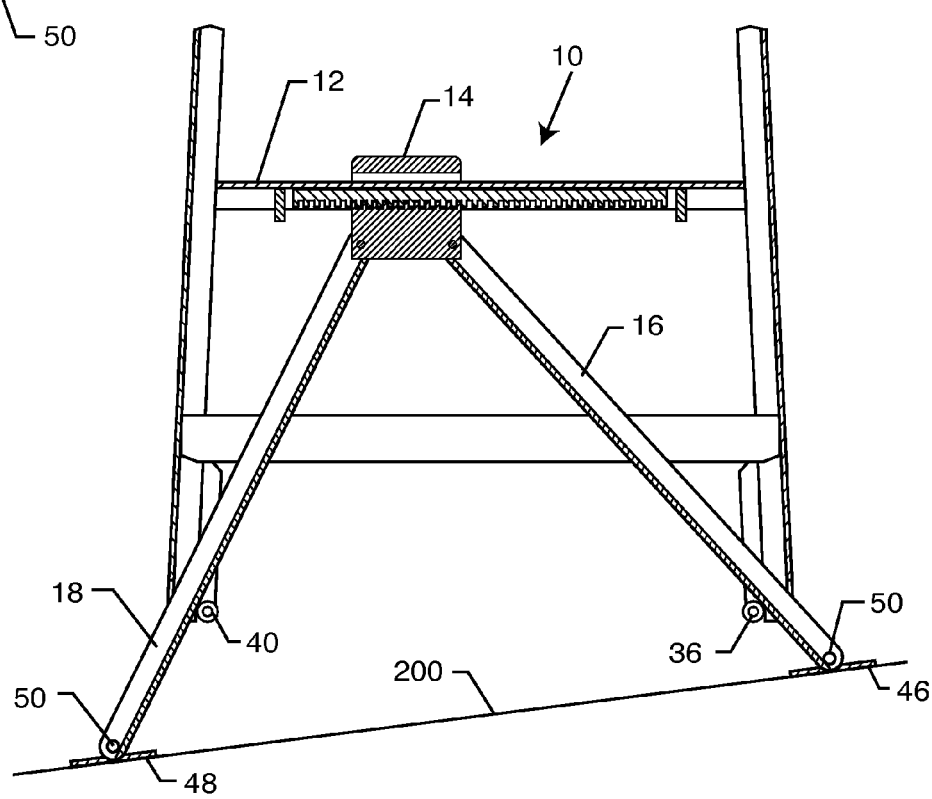
FIG. 6 is a cross-sectional view similar to FIG. 5, but illustrating the device on a sloped, instead of a stepped, uneven supporting surface.
Figure 7:
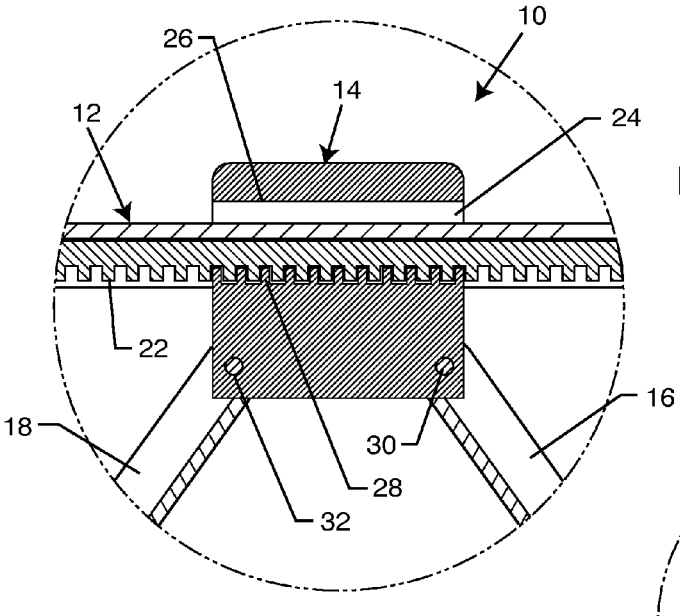
FIG. 7 is an enlarged cross-sectional view of area "7" of FIG. 4, illustrating locked engagement of a first locking member and a second locking member, in accordance with the present invention.
Figure 8:
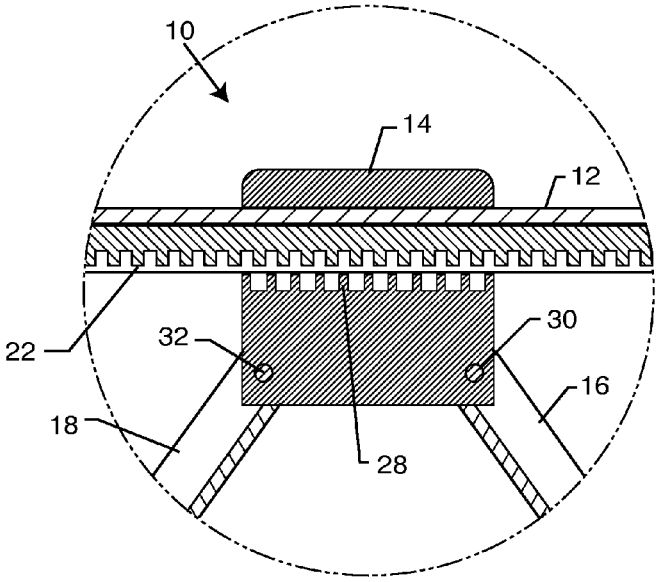
FIG. 8 is a cross-sectional view similar to FIG. 7, but illustrating the first and second locking members released from one another.

With particular reference now to FIGS. 3-8, in a particularly preferred embodiment, as illustrated, the first locking member 12 comprises a crossbeam which extends generally horizontally between the rails 108 and 110 of the ladder 100. The crossbeam member defines an open-faced channel 20 having a plurality of spaced-apart projections 22 disposed therein. The spaced-apart projections 22 can comprise a plurality of equally spaced-apart teeth, as illustrated. With particular reference to FIGS. 7 and 8, the second locking member 14 includes a passageway 24 therethrough which is sized and configured such that the first locking member crossbeam 12 passes therethrough. This is the case as illustrated in FIG. 8, when the second locking member 14 is not engaged with the first locking member 12, and is free to slidably move along a length of the first locking member 12. In such instance, a top ledge 26 defining the passageway 24 is in slidable contact with an upper and exterior surface of the first locking member crossbeam 12. Generally opposite ledge 26 are a plurality of projections 28 which are spaced apart and configured so as to be received within the spaces between the projections 22 of the first locking member 12, as illustrated in FIG. 7. This occurs when the legs 16 and 18 push the second locking member 14 upwardly, causing the projections 28 to become lodged and positioned between the projections or teeth 22 of the first locking member 12. This prevents the second locking member 14 from moving horizontally along the length of the first locking member 12, and effectively locks the legs 16 and 18 in position with respect to the supporting surface. Locking engagement occurs when the first and second legs 16 and 18 exert a sufficiently upward force to move the second locking member 14 upwardly into a locking engagement position, as illustrated in FIG. 7. This may occur when both the first and second legs 16 and 18 are both in engagement with the supporting surface 200. If a full locking engagement does not occur at that point, locking engagement will occur when the user steps upon rungs 106 or 112.

Figure 3:
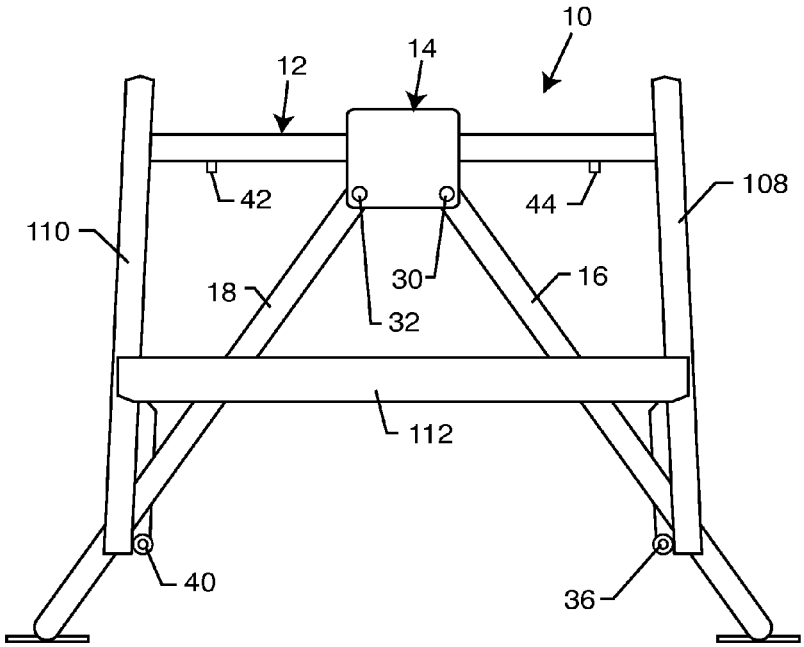
FIG. 3 is an enlarged elevational view of the self-adjusting ladder leveling device of the present invention.
Figure 4:
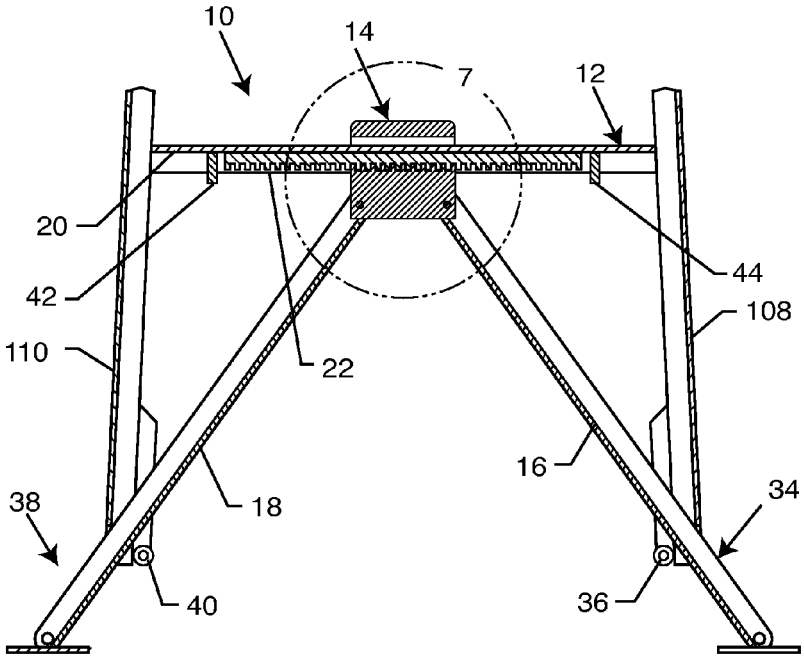
FIG. 4 is a cross-sectional view of FIG. 3, illustrating the component parts thereof.

As can be seen in FIGS. 5 and 6, even though the supporting surface 200 is uneven, rails 108 and 110 are generally parallel and vertical, such that the ladder is generally level. The legs 16 and 18 and the supporting surface 200 form a triangle structure which supports the ladder 100. As illustrated in FIGS. 5 and 6, when leg 16 engages an elevated portion of the supporting surface 200, the second locking member 14 is pushed and moved, in this case to the left until the second leg 18 comes into engagement with the supporting surface 200, at which point the second locking member 14 is moved upwardly and into engagement with the first locking member 12, as illustrated in FIGS. 6 and 8. It will be appreciated that if leg 18 were to be engaged with an upper portion of the supporting surface 200, then the second locking member 14 would be pushed to the right of center of the first locking member 12 until leg 16 engaged with a lower portion of the supporting surface 200, at which point the second locking member 14 would be moved upwardly and into engagement such that the projections 22 and 28 interlocked with one another such that the first and second locking members 12 and 14 were releasably in locked engagement with one another. Once the upward force of legs 16 and 18 was relieved, such as when lifting the ladder 100 upwardly, and more particularly either legs 16 and/or 18, then the second locking member 14 would automatically move out of engagement with the first locking member 12, permitting the second locking member 14 to freely move along a length of the first locking member 12. When placed on a generally even supporting surface 200, as illustrated in FIGS. 1 and 3, legs 16 and 18 position the second locking member 14 at approximately a mid-point or central location of the first locking member 12, and due to the upward force applied by the legs 16 and 18, which can occur when an individual steps on the rungs 112 of the ladder 100, the first and second locking members 12 and 14 would then be lockably engaged with one another, and the rungs or cross-members 106 and 112 would be generally horizontal indicating that the ladder was generally level.

Figure 12:
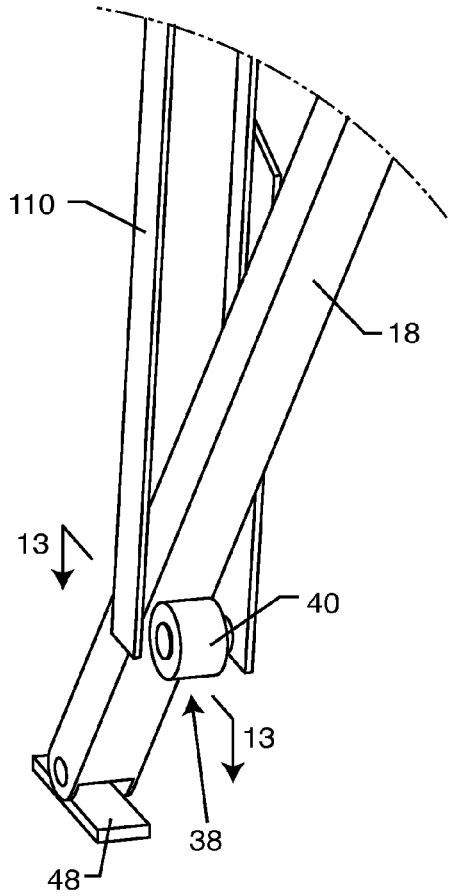
FIG. 12 is an enlarged perspective view of area "12" of FIG. 2, illustrating an arm passing through a guide in accordance with the invention.
Figure 13:
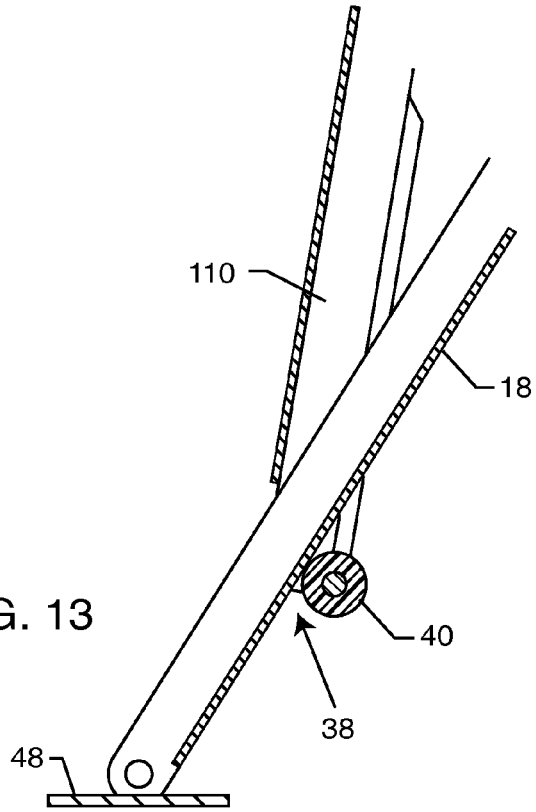
FIG. 13 is a cross-sectional view taken generally along line 13-13 of FIG. 12.

As mentioned above, legs 16 and 18 are pivotally connected to the second locking member 14, such as by means of pins 30 and 32 which interconnect a first end of each leg 16 and 18 to the second locking member 14. Preferably, a guide is associated with each rail 108 and 110 so as to guide the movement of each leg 16 and 18. For example, guide 34 comprises a channel or cutout of rail 108, as well as a roller 36 in spaced relation to the rail 108. Thus, leg 16 is limited in its movement between roller 36 and rail 108, thus limiting the horizontal movement of the leg 16, but allowing the length of the leg 16 to pass within the guide 34. Similarly, as illustrated in FIGS. 12 and 13, guide 38 for leg 18 also includes a roller 40 spaced apart from the rail 110 through which the leg 18 passes. The guides 38 and 34 also maintain a separation between legs 16 and 18 to force the legs 16 and 18 to form a generally triangular configuration with the supporting surface 200 at all times.

Also, it is undesirable that either leg 16 or 18 be positioned in a vertical orientation. Accordingly, stops 42 and 44 limit the horizontal movement of the second locking member 14 so as to maintain the legs 16 and 18 at an angled position between horizontal and vertical. Once again, this forces the legs 16 and 18 and the supporting surface 200 into a generally triangular configuration, which creates stability for the ladder 100. It will be appreciated by those skilled in the art that if legs 16 or 18 were permitted to move toward a vertical position, this stability would not be present. Although the stops 42 and 44 are illustrated in the preferred embodiment to limit the movement of the second locking member 14, it will be appreciated that such stops could be arranged to engage with the legs 16 or 18 instead. It is contemplated that the stops 42 and 44 instead of being associated with the first locking member 12, could instead be associated with the side rails 108 and 110, or even the guides 34 and 38 to achieve the same purpose.

Figure 9:
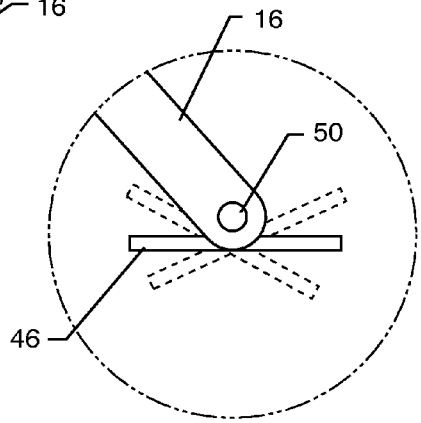
FIG. 9 is an enlarged view of a surface-engaging foot, used in accordance with the present invention.

With particular reference to FIGS. 5, 6 and 9, a surface-engaging foot 46 and 48 is pivotally attached to the second end of legs 16 and 18, such as by means of pin 50. This enables the surface-engaging foot 46 or 48 to pivot and engage the supporting surface 200. Thus, as illustrated in FIG. 5, the feet 46 and 48 are generally horizontal when engaged with generally flat, but stepped supporting surface 200; but angled to fully engage a sloped supporting surface 200, as illustrated in FIG. 6.

In operation using the A-frame ladder of FIGS. 1 and 2, the two stationary legs or rails 102 and 104 on the "climbing" side having the steps or rungs 106 are first placed on the supporting surface 200 to determine the foundation of the ladder 100. Legs 16 and 18 are then engaged with the supporting surface 200, moving the second locking member 14 with respect to the first locking member 12, as described above. When both legs 16 and 18 are engaged with the supporting surface 200, the upward force exerted from legs 16 and 18 will move the second locking member 14 into locking engagement with the first locking member 12, as discussed above. Regardless of the angle or terrain, the bottom ends of rails 102 and 104 and the lower ends of legs 16 and 18 are in contact with the supporting surface, while the ladder 100 remains generally level. When the individual steps off of the ladder, the ladder 100 is lifted upwardly, and legs 16 and 18 are lifted from the supporting surface 200, causing the second locking member 14 to become disengaged with the first locking member 12, and move freely with respect to it. That is, the second locking member 14 is able to slide freely to the left or right along the U-shaped channel and crossbeam of the first locking member 12.

Figure 10:
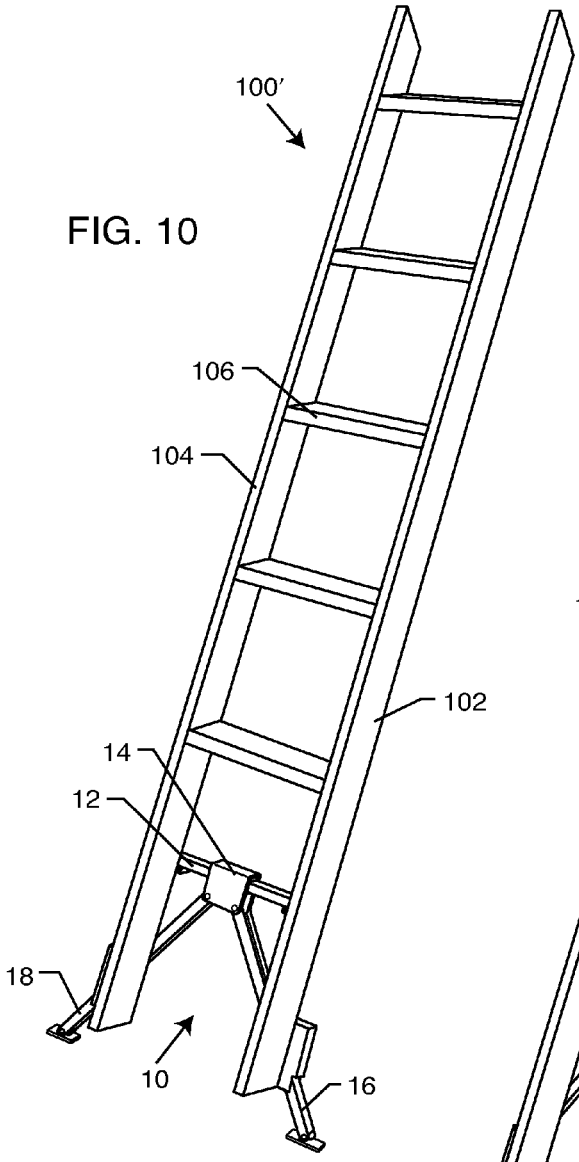
FIG. 10 is a perspective view of an extension ladder incorporating the device of the present invention, positioned on an even supporting surface.
Figure 11:
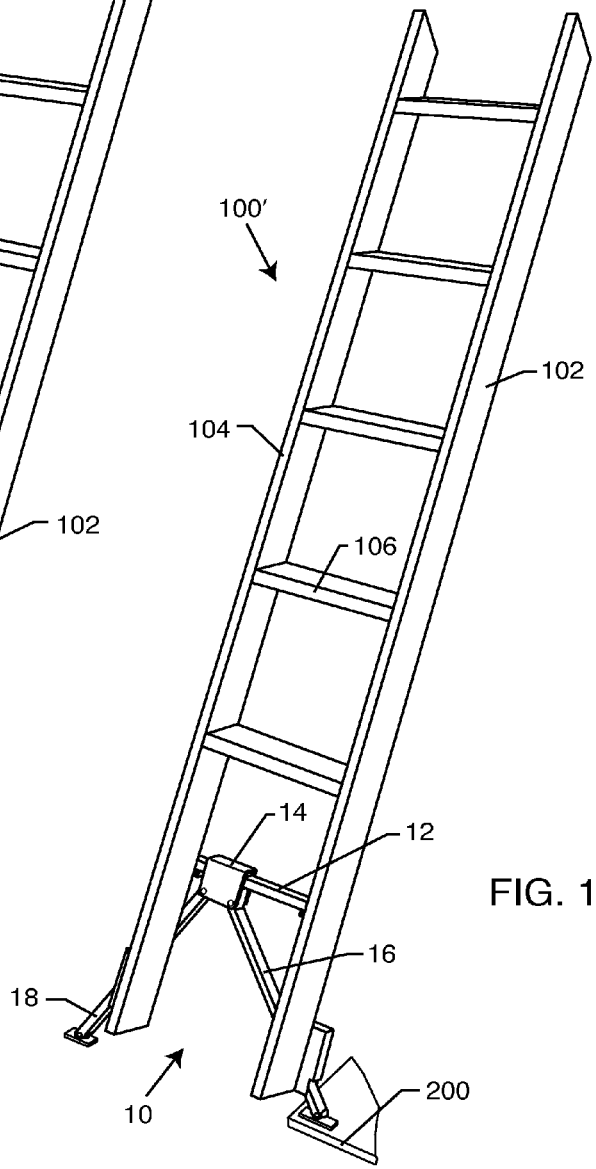
FIG. 11 is a perspective view similar to FIG. 10, but illustrating the ladder placed on an uneven supporting surface.

With reference now to FIGS. 10 and 11, the present invention is capable of being used not only on a step ladder or A-frame type of ladder as illustrated and described above, but also with respect to other ladders, such as extension ladders 100'. In such case, the first locking member defining crossbeam 12 extends between the generally parallel rail 102 and 104. At least a plurality of rungs 106 form steps. The first locking member 12 can be disposed below the lowermost rung 106, or between rungs 106. Otherwise, the device 10 of the present invention operates under the same principles as that described above so as to position the ladder 100' generally level, that is, rungs 106 are generally horizontal, even if the underlying supporting surface 200 is uneven. This is accomplished, as described above, without any manual movement, locking or unlocking, etc. of the device. Instead, the mere act of positioning the ladder on a supporting surface 200 causes the legs 16 and 18 to move the second locking member 14 with respect to the first locking member 12, and place it in locking engagement with the second locking member 12 when the ladder is positioned and in use, preventing the second locking member 14 from moving until the weight of the ladder 100 or 100' is lifted upwardly so as to disengage the first and second locking members 12 and 14. The positioning of the second locking member 14 with the first locking member 12, and the locking engagement and release of engagement between the first and second locking members 12 and 14 is done automatically due to the design and configuration of the device 10 of the present invention.

Preferably, the leveling device 10 of the present invention is built into and manufactured with the ladder 100. However, it will be appreciated by those skilled in the art that the leveling device 10 could be a retrofit and added to an existing ladder 100. This would require connecting the first locking member crossbeam 12 between the side rails 102 and 104, or 108 and 110. Legs 16 and 18 would extend downwardly from the second locking member 14, slidably positioned on the first locking member 12. The legs 16 and 18 would necessarily have to extend below the lowermost point of the side rails, so as to engage the supporting surface 200. This could possibly require the cutting or shortening of the side rails, or forming a hole or channel therein. Kits could be provided which would include the rollers 36 and 40 to form guides 34 and 38 by connecting the rollers 36 and 40 to the side rails so as to guide the movement of legs 16 and 18.

Although several embodiments have been described in some detail for purposes of illustration, various modifications may be made without departing from the scope and spirit of the invention. Accordingly, the invention is not to be limited, except as by the appended claims.

What is claimed is:

1. A self-adjusting leveling ladder comprising:

first and second generally parallel and interconnected side rails;

third and fourth generally parallel side rails connected by a plurality of step rungs spaced apart from one another along a length of the third and fourth side rails, the third and fourth side rails being pivotally connected to the first and second side rails so as to form an A-frame step ladder;

a first locking member extending between the first and second side rails and having a plurality of spaced apart projections extending substantially a length of the first locking member;

a second locking member associated with the first locking member so as to slidably move along a substantial length of the first locking member;

a first leg having a first end pivotally attached to the second locking member and with a longitudinal axis extending downwardly from the second locking member at an angle; and a second leg having a first end pivotally attached to the second locking member and with a longitudinal axis extending downwardly from the second locking member at an angle; and the first locking member extends through a passageway formed in the second locking member, the second locking member is configured to freely slide horizontally along a length of the first locking member when one of the first leg and the second leg is exerting a force to the second locking member, and move vertically into releasable engagement with the first locking member when the first and second legs exert an upward force to the second locking member; and a first guide associated with the first rail for guiding a movement of the first leg within the first guide, and a second guide associated with the second rail for guiding a movement of the second leg within the second guide.

2. The self-adjusting ladder of claim 1, wherein the spaced apart projections of the first locking member are disposed in an open-faced channel facing at least a portion of the second locking member.

3. The self-adjusting ladder of claim 1, wherein the second locking member includes at least one projection configured to be inserted between the spaced apart projections of the first locking member so as to lock the first and second locking members into engagement with one another and prevent the second locking member from slidably moving along the length of the first locking member.

4. The self-adjusting ladder of claim 1, including first and second stops to limit a horizontal movement of the second locking member.

5. The self-adjusting ladder of claim 1, wherein the first and second guides each include a cylindrical member in spaced relation to the first or second rail.

6. The self-adjusting ladder of claim 5, wherein the first leg is disposed between the cylindrical member of the first guide and the first rail of the first guide, and the second leg is disposed between the cylindrical member of the second guide and the second rail of the second guide.

7. The self-adjusting ladder of claim 1, including a surface-engaging foot pivotally connected to a second end of the first leg and a second surface-engaging foot pivotally connected to a second end of the second leg.

8. The self-adjusting ladder of claim 1, wherein a second end of the first leg extends outward of a longitudinal axis of the first rail and a second end of the second leg extends outward of a longitudinal axis of the second rail, such that there is a greater distance between the second ends of the first and second legs than a distance between the first and second rails.

9. A self-adjusting leveling ladder comprising:

first and second generally parallel and interconnected side rails;

third and fourth generally parallel side rails connected by a plurality of step rungs spaced apart from one another along a length of the third and fourth side rails, the third and fourth side rails being pivotally connected to the first and second side rails so as to form an A-frame step ladder;

a first locking member comprising a generally horizontally oriented cross bar extending between the first and second side rails;

a second locking member slidably attached to the first locking member so as to slide along a substantial length of the first locking member;

a first leg having a first end pivotally attached to the second locking member and with a longitudinal axis extending downwardly from the second locking member at an angle;

a second leg having a first end pivotally attached to the second locking member and with a longitudinal axis extending downwardly from the second locking member at a non-perpendicular angle;

a first guide associated with the first rail and the first leg for guiding a movement of the first leg; and a second guide associated with the second rail and the second leg for guiding a movement of the second leg;

wherein the second locking member is configured to freely slide horizontally along a length of the first locking member when one of the first leg and the second leg is exerting a force to the second locking member, and move vertically into engagement with the first locking member when both the first and second legs exert an upward force to the second locking member;

wherein the first locking member includes an open-faced channel having a plurality of spaced apart projections disposed therein and extending substantially a length of the open-faced channel, wherein the second locking member includes at least one projection configured to be inserted between the spaced apart projections of the first locking member so as to lock the first and second locking members into engagement with one another and prevent the second locking member from moving horizontally along a length of the first locking member; and wherein the first guide includes a first cylindrical member in spaced relation to the first rail, the first leg being disposed between the first rail and the first cylindrical member for guiding a movement of the first leg within and along the first guide, and the second guide includes a second cylindrical member in spaced relation to the second rail, the second leg being disposed between the second rail and the second cylindrical member for guiding a movement of the second leg within and along the second guide.

10. The self-adjusting ladder of claim 9, including first and second stops to limit the horizontal movement of the second locking member.

11. The self-adjusting ladder of claim 9, including a surface-engaging foot pivotally connected to a second end of the first leg and a second surface-engaging foot pivotally connected to a second end of the second leg.

12. The self-adjusting ladder of claim 9, wherein a second end of the first leg extends outward of a longitudinal axis of the first rail and a second end of the second leg extends outward of a longitudinal axis of the second rail, such that there is a greater distance between the second ends of the first and second legs than a distance between the first and second rails.

13. The self-adjusting ladder of claim 9, wherein the first locking member extends through a passageway formed in the second locking member.

14. A self-adjusting leveling ladder comprising:

first and second generally parallel and interconnected side rails;

third and fourth generally parallel side rails connected by a plurality of step rungs spaced apart from one another along a length of the third and fourth side rails, the third and fourth side rails being pivotally connected to the first and second side rails so as to form an A-frame step ladder;

a first locking member comprising a generally horizontally oriented cross bar extending between the first and second side rails and defining an open-faced channel having a plurality of spaced apart projections extending substantially a length of the first locking member;

a second locking member slidably attached to the first locking member;

a first leg having a first end pivotally attached to the second locking member and with a longitudinal axis extending downwardly from the second locking member at an angle so as to extend outwardly of a longitudinal axis of the first rail;

a surface-engaging foot pivotally connected to a second end of the first leg;

a second leg having a first end pivotally attached to the second locking member and with a longitudinal axis extending downwardly from the second locking member at an angle so as to extend outwardly of a longitudinal axis of the second rail, a distance between a second end of the first leg and a second end of the second leg being greater than a distance between the first and second rails;

a second surface-engaging foot pivotally connected to the second end of the second leg;

a first guide associated with the first rail and the first leg for guiding a movement of the first leg within and along the first guide; and a second guide associated with the second rail and the second leg for guiding a movement of the second leg within and along the second guide;

wherein the second locking member is configured to slide horizontally along a length of the first locking member when one of the first leg and the second leg is exerting a force to the second locking member, and move vertically into engagement with the first locking member such that at least one projection of the second locking member is inserted between the first locking member projections to prevent horizontal movement of the second locking member when both the first and second legs exert an upward force to the second locking member.

15. The self-adjusting ladder of claim 14, including first and second stops to limit the horizontal movement of the second locking member.

16. The self-adjusting ladder of claim 14, wherein the first guide includes a first cylindrical member in spaced relation to the first rail, the first leg being disposed between the first rail and the first cylindrical member, and the second guide includes a second cylindrical member in spaced relation to the second rail, the second leg being disposed between the second rail and the second cylindrical member.

17. The self-adjusting ladder of claim 14, wherein the first locking member extends through a passageway formed in the second locking member.

* * * * *